US005836358A

United States Patent [19]

Byrd et al.

[11] Patent Number: 5,836,358

[45] Date of Patent: Nov. 17, 1998

[54] FILL PORT COVERS

[75] Inventors: Gary N. Byrd, Donahue, Iowa; Dale L. Selhost, Moline, Ill.

[73] Assignee: Litton Systems, Inc., Davenport, Iowa

[21] Appl. No.: 898,759

[22] Filed: Jul. 23, 1997

[51] Int. Cl.[6] ..... B65B 1/04

[52] U.S. Cl. ..... 141/18; 222/3; 141/384; 141/383

[58] Field of Search ..... 141/2, 3, 4, 18, 141/21, 382, 383, 384, 363, 364; 222/3, DIG. 1; 220/200; 206/0.6

[56] References Cited

U.S. PATENT DOCUMENTS

| | | | |
|---|---|---|---|
| 3,618,822 | 11/1971 | Hildenbrandt | 222/3 |
| 4,615,364 | 10/1986 | Kawata | 141/364 |
| 4,937,628 | 6/1990 | Cipolla et al. | 141/364 |
| 5,091,750 | 2/1992 | Yoshida et al. | 141/364 |
| 5,351,728 | 10/1994 | Ban et al. | 141/364 |
| 5,363,177 | 11/1994 | Nakano et al. | 141/364 |
| 5,582,223 | 12/1996 | Weh et al. | 141/383 |

*Primary Examiner*—J. Casimer Jacyna
*Assistant Examiner*—Kerry S. Culpepper
*Attorney, Agent, or Firm*—Michael H. Wallach; Gerald L. Lett; Scott J. Coonan

[57] ABSTRACT

A cover for a fill port of a flow controller of a high pressure fitting for filling a cylinder with a pressurized gas. The cover has a slidable cover plate having elongated flexible members attached thereto, such member having a locking projection that cooperatively fits into a locking recess on the cover plate. The cover plate is movable from a first position covering the fill port to a second position away therefrom. Elastomeric means bias the cover plate towards the first position. A fill port adaptor is used to fill the cylinder through the fill port, and may have a cover that prevents operation when the cover is in place. Both covers are adapted to open when the flow controller is properly placed in a cradle that forms part of the fill port adaptor.

20 Claims, 9 Drawing Sheets

FILL PORT COVERS

FIELD OF THE INVENTION

The present invention relates to a cover for fill ports of pressurized apparatus, and especially to covers for fill ports of an integrated high pressure fill port and flow controller for recharging of cylinders or other pressurized vessels. The covers are intended to prevent or reduce contamination of fill ports in cylinders and other pressurized vessels and related apparatus for filling such cylinders. In particular embodiments, the covers are intended for use with a recharger used in association with an oxygen concentrator e.g. a home health care oxygen concentrator, especially as part of the flow controller of the oxygen concentrator.

BACKGROUND OF THE INVENTION

There are a number of instances where the provision of oxygen-enriched air, sometimes referred to as oxygen, is required to be provided at a low pressure. One particular situation where such low pressure oxygen-enriched air is required is in the health care field, both in the health care field within various institutions as well as within a patient's home. In such situations, it may be necessary to provide a continuous flow of low pressure oxygen-enriched air to a patient on an on-going basis. While such patients may be able to withstand the absence of the flow of oxygen-enriched air for short periods of time, such patients frequently are unable to withstand the absence of such a flow of oxygen-enriched air for longer periods of time without suffering major health problems. In particular, such patients are normally not able to move from one location to another without oxygen-enriched air.

One of the disadvantages of known processes for the supply of oxygen-enriched air at low pressure is that such processes lack the flexibility to allow the patient to be located at a fixed location but also to be able to move from that location with relative ease with an assurance that the source of oxygen-enriched air is sufficient. For instance, the patient may wish or need to be able to move from a bed or other similar location, e.g. to use toilet facilities, prepare meals, go to another room or change locations for other reasons. Such mobility with existing processes generally requires a patient to be disconnected from a first source of low pressure oxygen-enriched air and to be re-connected to a second system for provision of such air and which is mobile e.g. a cylinder of oxygen-enriched air. The patient would want an assurance that the source of oxygen-enriched air is sufficient, which would be of particular concern if the patient wished to be mobile for an extended period of time e.g. a day or weekend, without having to re-fill the mobile, or ambulatory, cylinder at a dealer or distributor.

An oxygen concentrator is disclosed in U.S. patent application Ser. No. 08/797,828 of Kevin G. McCulloh, Dale L. Selhost, John W. Henneman and Kelly M. Coffield, filed Feb. 10, 1997. An integrated high pressure fill port and flow controller that may be used to charge oxygen from an oxygen concentrator into a pressurized vessel e.g. a cylinder, is disclosed in U.S. patent application Ser. No. 08/797,823 of Gary Byrd, also filed Feb. 10, 1997. Such oxygen concentrator and integrated high pressure fill port and flow controller provide a supply of oxygen-enriched air and the ability to recharge a cylinder with oxygen-enriched air to enable a patient to be mobile.

In use of a concentrator and especially an integrated high pressure fill port and flow controller, and related apparatus, it is important to eliminate or reduce contamination e.g. dirt or pollutants, for effective filling and use of the pressurized cylinder or other vessel.

SUMMARY OF THE INVENTION

A cover has now been found for use, for example, with an integrated high pressure fill port and flow controller, especially for protection of the fill ports in such a high pressure fill port and flow controller.

Accordingly, an aspect of the present invention provides a cover for a fill port in a housing of a pressurized vessel, said cover comprising a cover plate capable of sliding from a first position to a second position and at least one elongated curved member adapted to be located in a circular groove in said housing, said elongated curved member having opposed ends each of which may be attached to the cover plate.

In a preferred embodiment of the invention, one end of the elongated flexible member is integrally connected to the cover plate.

A further aspect of the present invention provides a flow controller for a pressurized vessel, said flow controller having a fill port for pressurizing of said vessel, said fill port being recessed in a housing, said fill port having a cover comprising a cover plate capable of sliding from a first position to a second position, said first position covering said fill port, said cover being biased towards said first position, said housing having at least one circular groove and said cover plate having an elongated curved member located in said circular groove, said elongated curved member having opposed ends each of which may be attached to the cover plate.

Another aspect of the present invention provides a high pressure fitting for filling a cylinder with a pressurized gas, said fitting having a fill port adaptor with a movable injection port, said fill port adaptor being open for flow of gas into a flow controller of said cylinder when said injection port is received in a fill port in said flow controller and closed for flow of gas when not so received, said movable injection port having a cover thereon that is movable from a first position to a second position, said first position covering said movable injection port and preventing movement of said movable injection port, and said second position permitting said movable injection port to enter said fill port in the flow controller.

Yet another aspect of the present invention provides apparatus for filling a cylinder with a pressurized gas, said apparatus comprising a high pressure fitting having a fill port adaptor and a flow controller system located on said cylinder;

said fill port adaptor having a movable injection port, a cradle and a locking clamp;

said flow controller system having a fill port located in a housing and cooperatively adapted to receive said movable injection port, said flow controller and said fill port adaptor being open for flow of gas when said movable injection port is received in said fill port and closed for flow of gas when not so received;

said locking clamp being adapted to lock the flow controller system of the cylinder in said cradle of the high pressure fitting;

said movable injection port having a cover thereon that is moved from a first position to a second position when the flow controller is placed in the cradle, said first position covering said movable injection port and preventing movement of said movable injection port, and said second position permitting said movable injection port to enter said fill port.

In a preferred embodiment of the present invention, the flow controller has two radial grooves on opposed sides of said inlet, said cover plate having elastic means to bias said cover plate towards said first position.

In another embodiment, the fill port of the flow controller system has a cover comprising a cover plate capable of sliding from a first position to a second position, said first position covering said fill port, said cover being biased towards said first position, said housing having at least one circular groove and said cover plate having an elongated curved member located in said circular groove, said elongated curved member having opposed ends each of which is attached to the cover plate, said cover plate being moved from the first position to the second position when the controller is placed in the cradle, said second position permitting said fill port to receive said movable injection port.

BRIEF DESCRIPTION OF THE DRAWINGS

The present invention is illustrated by the embodiments shown in the drawings in which.

DETAILED DESCRIPTION OF THE INVENTION

Figure 1:
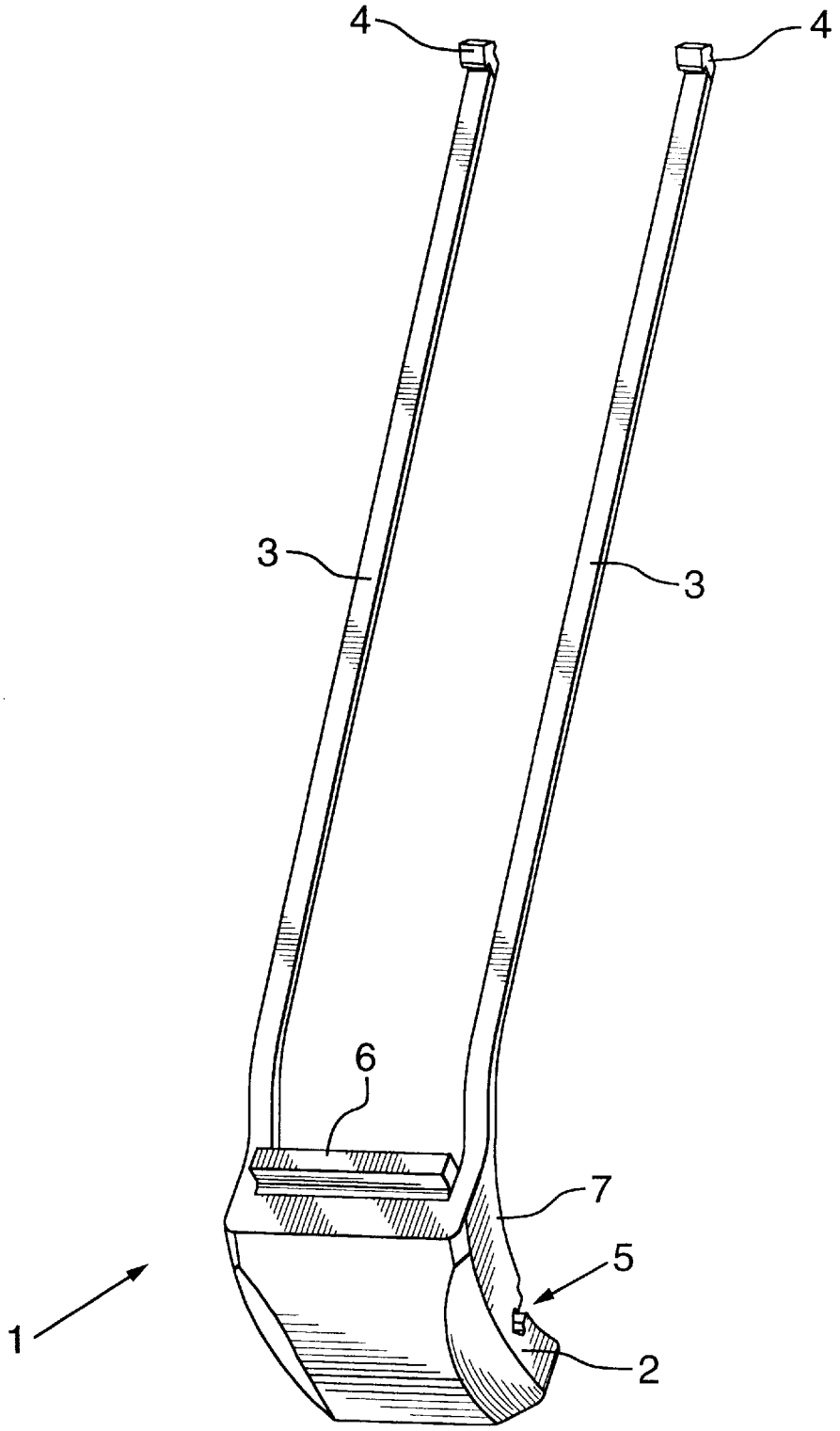
FIG. 1 is a schematic representation of a perspective view of a cover of the invention.

FIG. 1 shows a cover of the invention, generally indicated by 1. Cover 1 has cover plate 2 with two elongated flexible members 3 extending from opposed sides of one end of cover plate 2. The embodiment shown shows two elongated flexible members, but it is to be understood that one or more curved flexible members may be used.

Projection 4 has an arrow-head shape, in the embodiment shown, which is complementary in shape to locking recess 5 that is located in the underside of cover plate 2. It is to be understood that a variety of shapes of locking projection 4 may be used, with complementary shapes of locking recess 5, such that locking projection 4 may be inserted in and retained in locking recess 5, as discussed below. It is understood that elongated flexible member 3 has sufficient flexibility such that elongated flexible member 3 may be bent so that locking projection 4 will fit into and be retained in locking recess 5 on its cover plate 2. It is preferred that one end of elongated flexible member 3 be integrally connected to cover plate 2, although flexible elongated member 3 could be other than integral with cover plate 2 i.e. a separate article, with locking projections 4 on each end which would be inserted in and retained in corresponding locking recesses 5 in cover plate 2.

Cover plate 2 has cover lip 6 extending laterally across cover plate 2 between elongated flexible members 3. Cover lip 6 is intended for retention of an elastomeric member, as discussed below. Surface 7 on the underside of cover plate 2, which extends partially into elongated flexible members 3, is curved, as more clearly seen in FIG. 3. Surface 7 is preferably contoured to slide along a groove, as discussed below, and in particularly preferred embodiments forms an arc of a circle.

Figure 2:
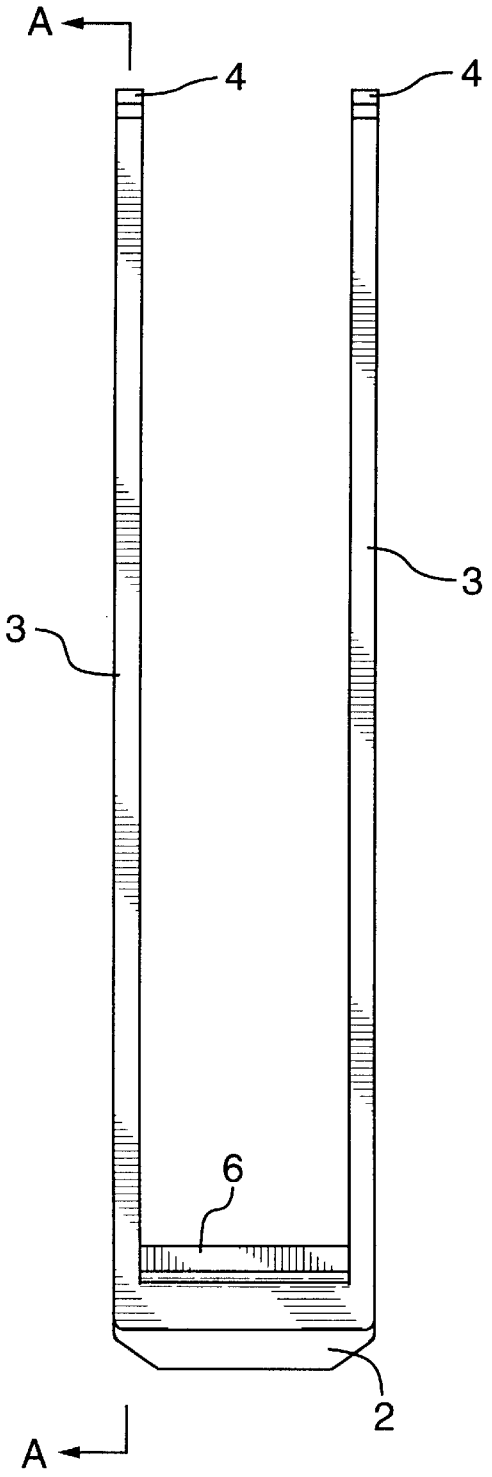
FIG. 2 is a schematic representation of an end view of the cover of FIG. 1.

FIG. 2 shows that elongated flexible members 3 extend linearly from cover plate 2, in a parallel relationship.

Figure 3:
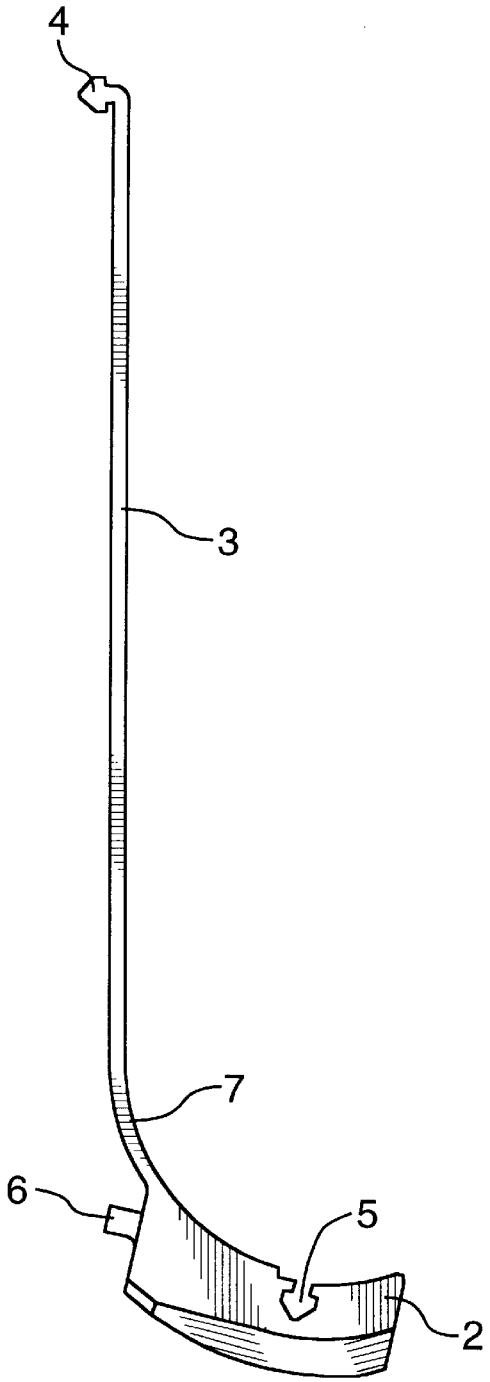
FIG. 3 is a schematic representation of a cross-section of the cover of the invention, along A—A of FIG. 2.

FIG. 3 shows a cross section of cover 1 through A—A of FIG. 2. The arcuate shape of surface 7 extending from cover plate 2 into elongated flexible member 3 is shown in FIG. 3. In addition, FIG. 3 shows an embodiment of an arrow-head shape of both locking projection 4 and locking recess 5, such shapes being complementary such that locking projection 4 may be inserted in and retained in locking recess 5, as discussed herein. Cover lip 6 extends from the end of cover plate 2 juxtaposed to elongated flexible member 3.

Figure 4:
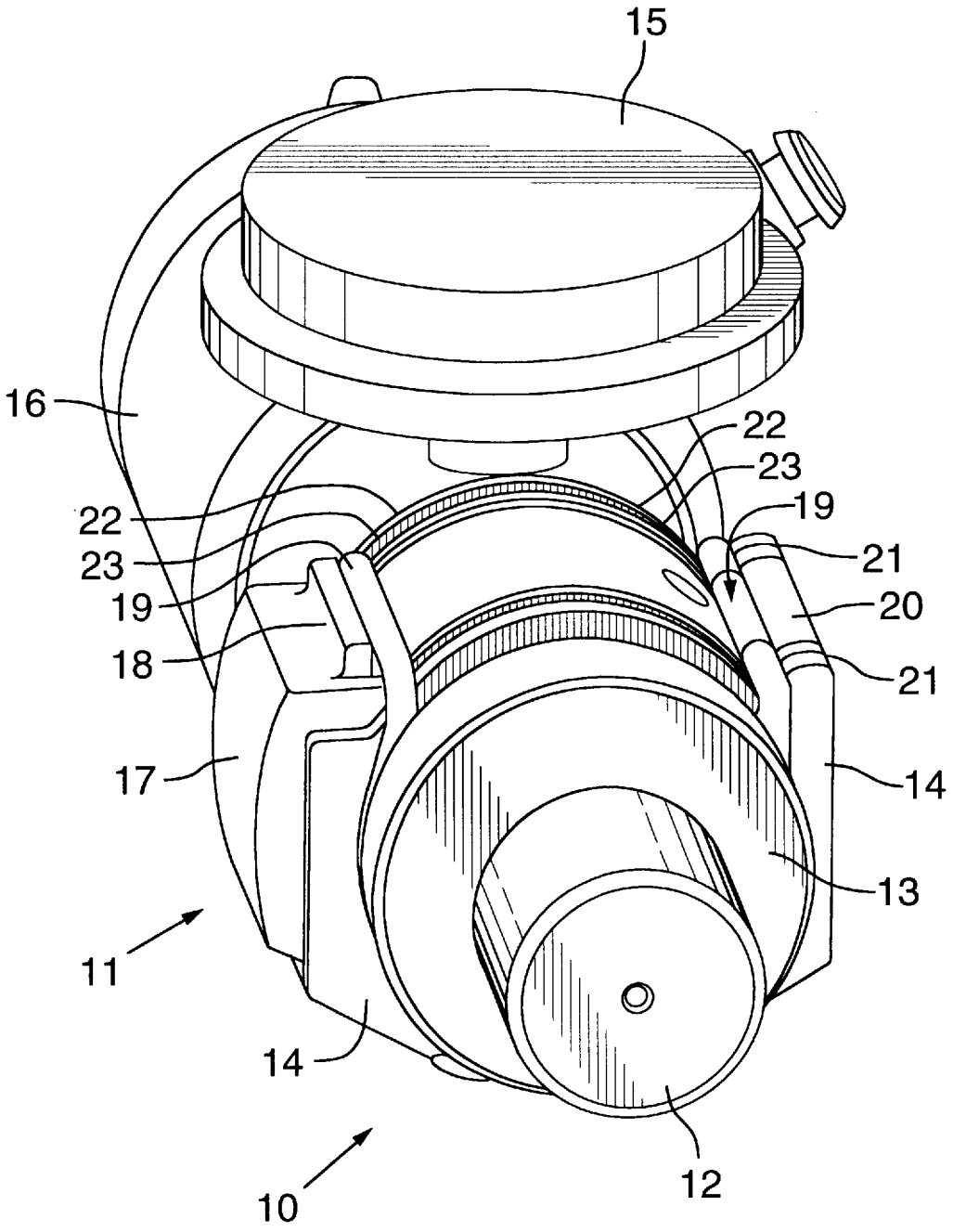
FIG. 4 is a schematic representation of a perspective view of a cover on a flow controller.

FIG. 4 shows a flow controller, generally indicated by 10, with a cover generally indicated by 11. Flow controller 10 has threaded port 12 extending from housing 13. Housing 13 has integral cradle housing 14 thereon, which is in the shape of a truncated hexagon. Pressure gauge 15 extends from housing 13 and ON/OFF knob 16 is on the end of flow controller 10 opposed to threaded port 12. An embodiment of such a flow controller is disclosed in the aforementioned U.S. patent application Ser. No. 08/797,823.

Cover plate 17 of cover 11 is located on one face of the truncated hexagon that forms integral cradle housing 14. Cover plate 17 has cover lip 18 thereon. Elastic cord 19, which may be any elastomeric member achieving the function described below, passes from adjacent cover lip 18 around integral cradle housing 14 and is retained in the opposed side of integral cradle housing 14 by cradle housing lip 20. Elastic cord 19 is retained in elastic cord groove 22. The elongated flexible member of cover plate 17 is not shown in FIG. 4, but is retained in elongated member groove 23 in housing 13, passing through cradle housing groove 21 in cradle housing lip 20. The elongated flexible member is retained within housing 13, especially elongated member groove 23 thereof, by elastic cord 19.

Figure 5:
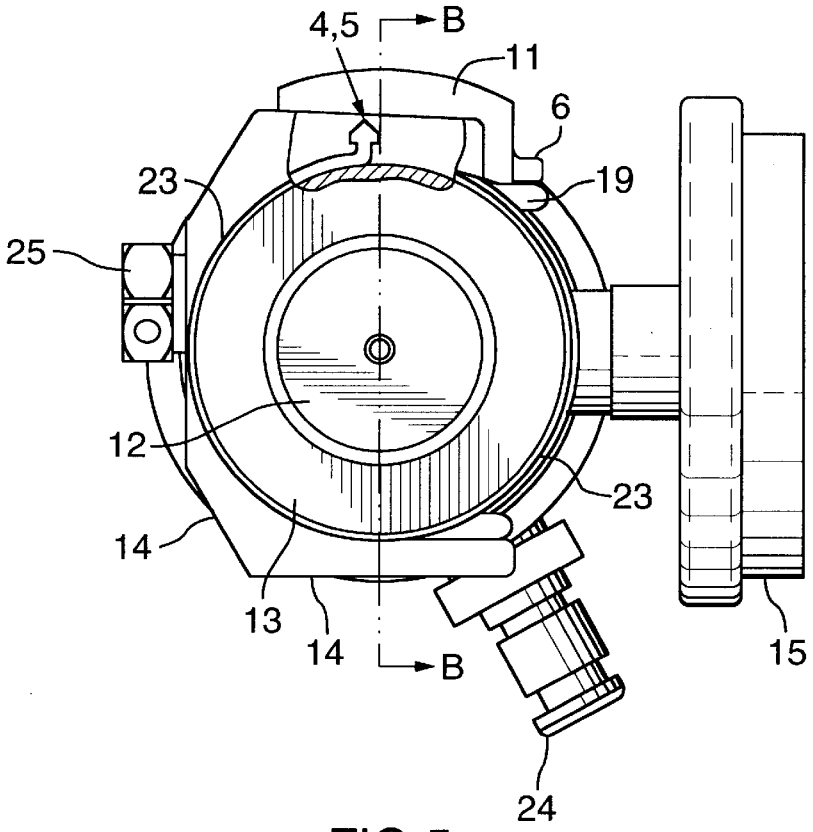
FIG. 5 is a schematic representation of a cross-section of the cover on a flow controller.

FIG. 5 shows a cross section of the apparatus of FIG. 4. The flow controller has housing 13 with threaded port 12 extending therefrom. Housing 13 has integral cradle housing 14 in the form of a truncated hexagon extending partially around housing 13. Pressure gauge 15, outlet fitting 24 and rupture disk housing 25 extend from housing 13.

Cover plate 17 has elongated flexible member 3 extending around housing 13 in elongated member groove 23. Locking projection 4 is inserted in locking recess 5, indicated in FIG. 5 as 4/5. Cover plate 17 is over fill port 29.

Figure 6:
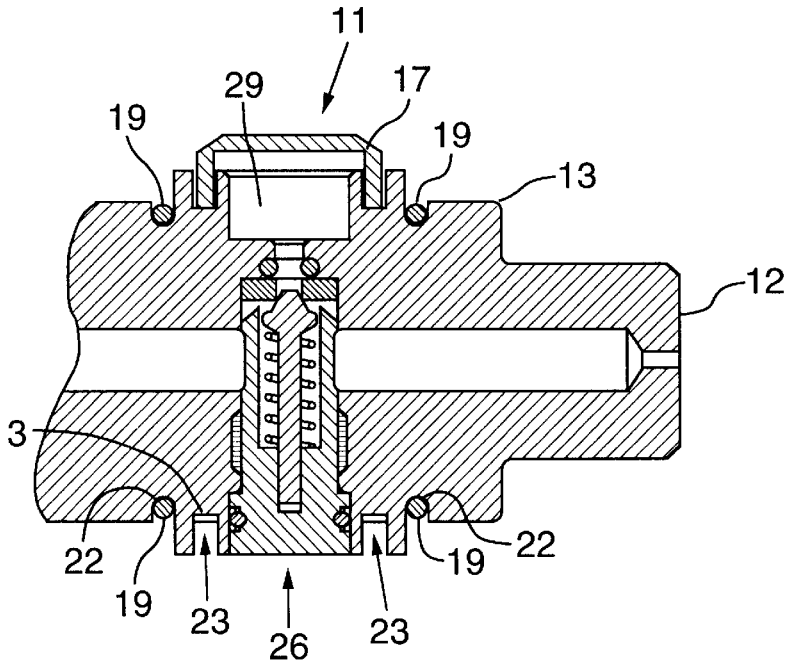
FIG. 6 is a schematic representation of a cross-section of the cover on a flow controller, through B—B of FIG. 5.

In the cross section of FIG. 6, cover plate 11 has elongated flexible member located in elongated member groove 23, cover plate 17 having two such elongated members. Elastic cord 19 is shown in elastic cord groove 22. An inlet valve of the flow controller is generally indicated by 26, and has been described previously in the aforementioned U.S. patent application Ser. No. 08/797,823.

Figure 7:
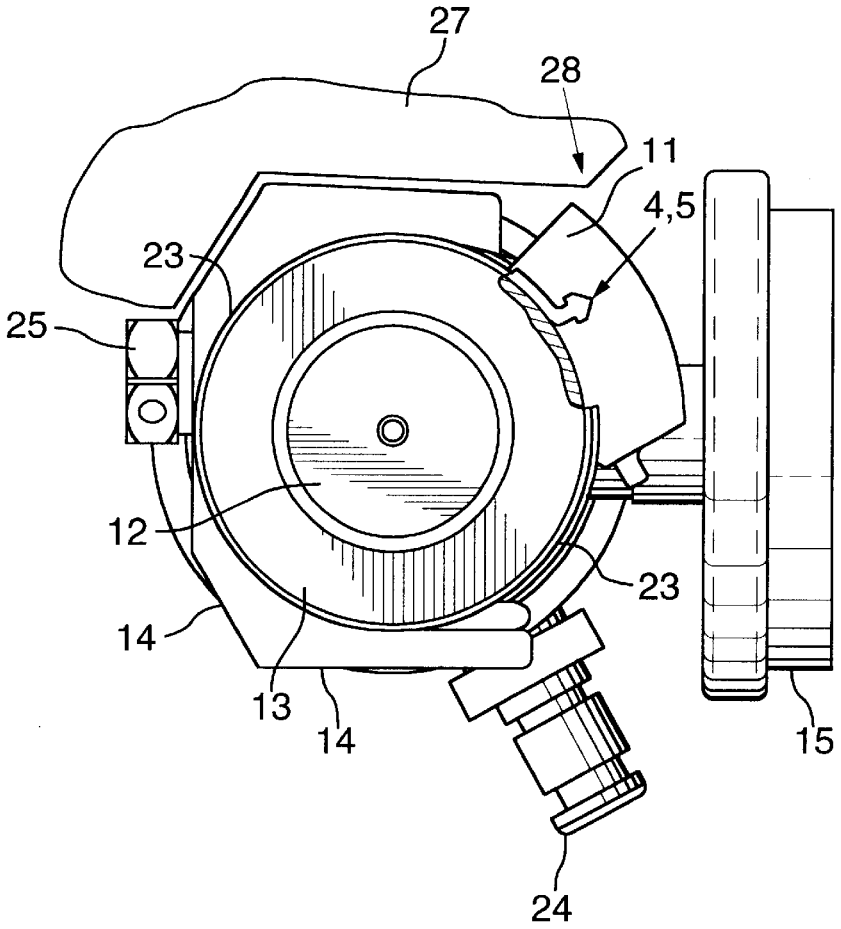
FIG. 7 is a schematic representation of the cover on flow controller shown in FIG. 6 with the cover in the open position.

FIG. 7 shows the embodiment of FIG. 5, with cover plate 17 in the open position i.e. not covering the fill port. The flow controller has been inserted into a recharger housing, partially shown in FIG. 7 and represented by 27, which has moved cover plate 17 from its closed position in FIG. 5 to the open position shown in FIG. 7. A part of recharger housing 27, indicated as recharger housing corner 28 has come into physical contact with cover plate 17 and caused it to move into the position shown in FIG. 7.

Figure 8:
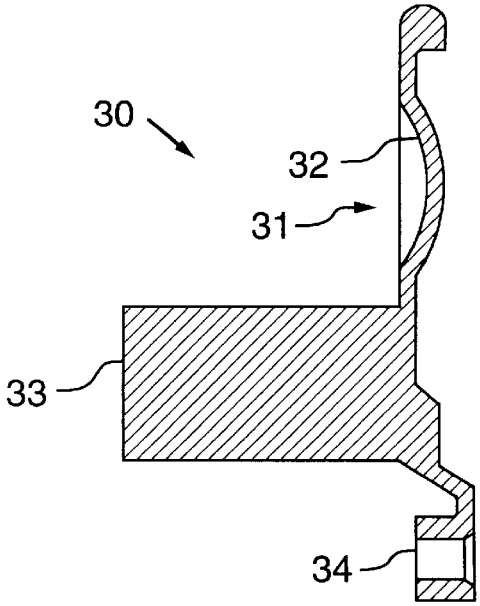
FIG. 8 is a schematic representation of a cover for a fill port adaptor.

FIG. 8 shows a fill port adaptor cover, generally indicated by 30. Fill port adaptor cover 30 has a plate section 31, with a convex section 32 therein. Plate section 31 is connected on its lower end to cover stop 33 which in turn is connected to cover connector orifice 34.

Figure 9:
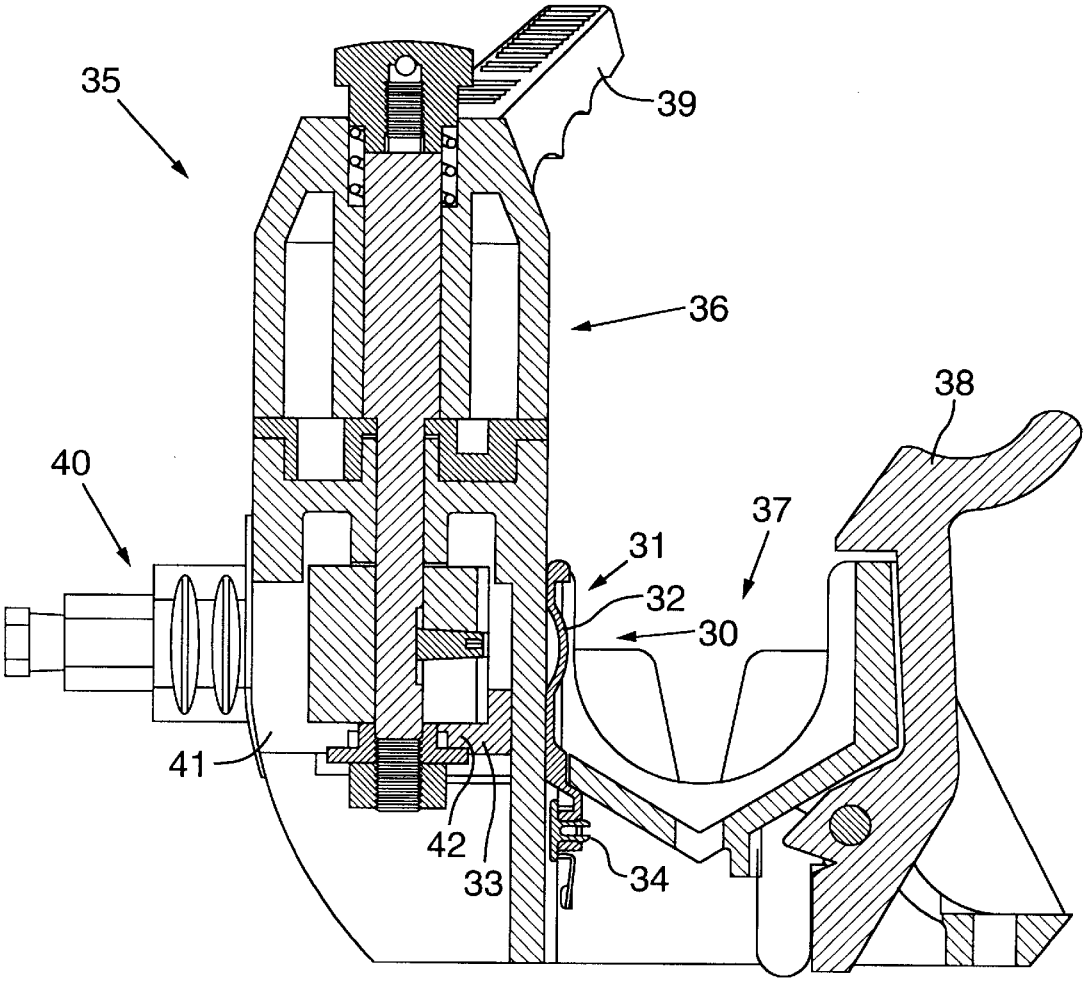
FIG. 9 is a schematic representation of a cover in a fill port adaptor.

FIG. 9 shows a fill port adaptor, generally indicated by 35. Fill port adaptor 35 has control mechanism 36 with handle 39 attached thereto. Fill port adaptor 35 has cradle 37 adapted to receive a flow controller, as described hereinabove. Fill port adaptor 35 has locking clip 38 for retention of a flow controller within cradle 37. Control mechanism 36 has gear rack 40 located therein, which is adapted to move to the right as illustrated on movement of handle 39. Gear rack shaft 41 extends into control mechanism 36 and has shaft face 42 thereon.

A fill port adaptor cover, 30, is located adjacent to control mechanism 36 in cradle 37. Convex section 32 is located opposite gear rack shaft 41 of gear rack 40, and cover stop 33 extends into control mechanism 36 and abuts shaft face 42.

Figure 10:
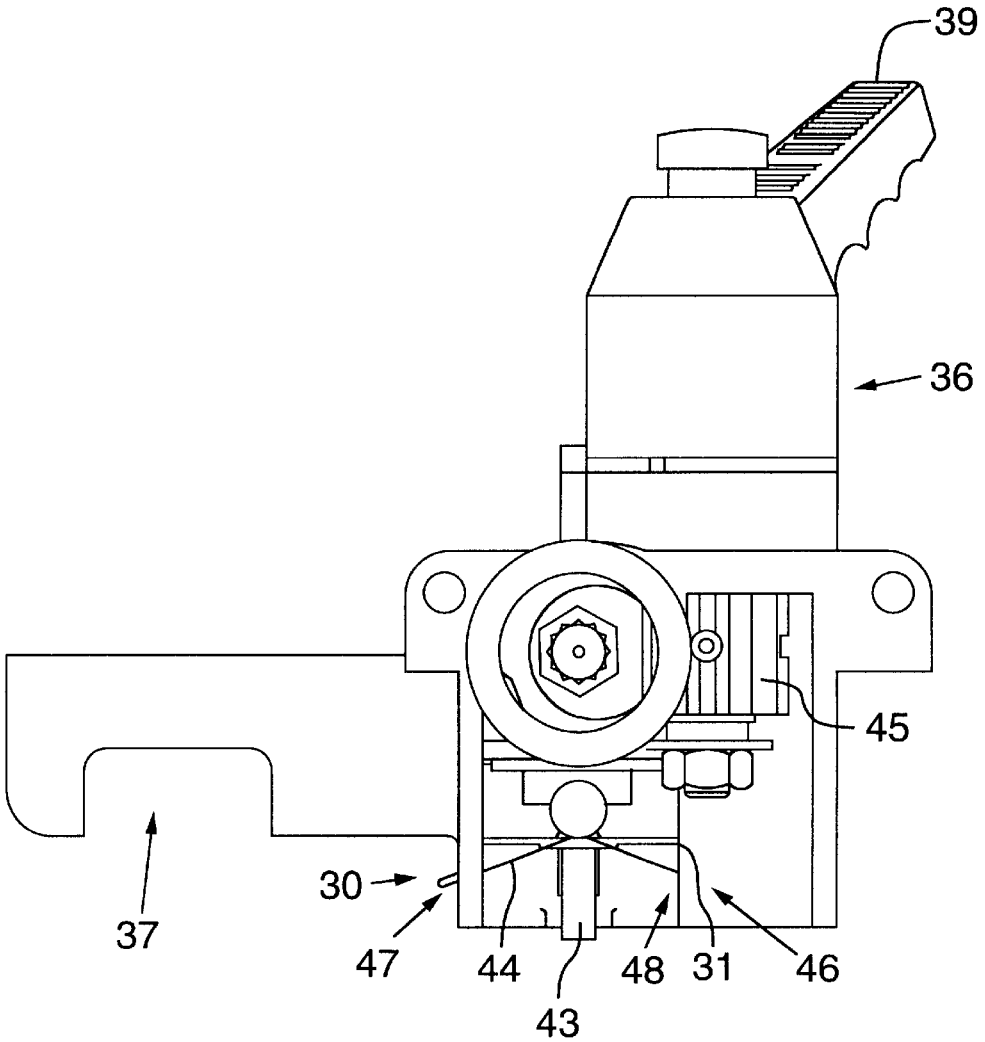
FIG. 10 is a schematic representation of a side view of the fill port adaptor of FIG. 9.

FIG. 10 shows fill port adaptor 35 having control mechanism 36 extending therefrom with handle 39. Gear wheel 45 is located at the lower end of control mechanism 36. Fill port adaptor cover 30 has plate section 31, shown in end view, with cover guide 43 extending therefrom. Cover spring 44 is attached to fill port adaptor cover 30, with the ends thereof extending through orifices located in the housing 46, at orifices 47 and 48.

Figure 11:
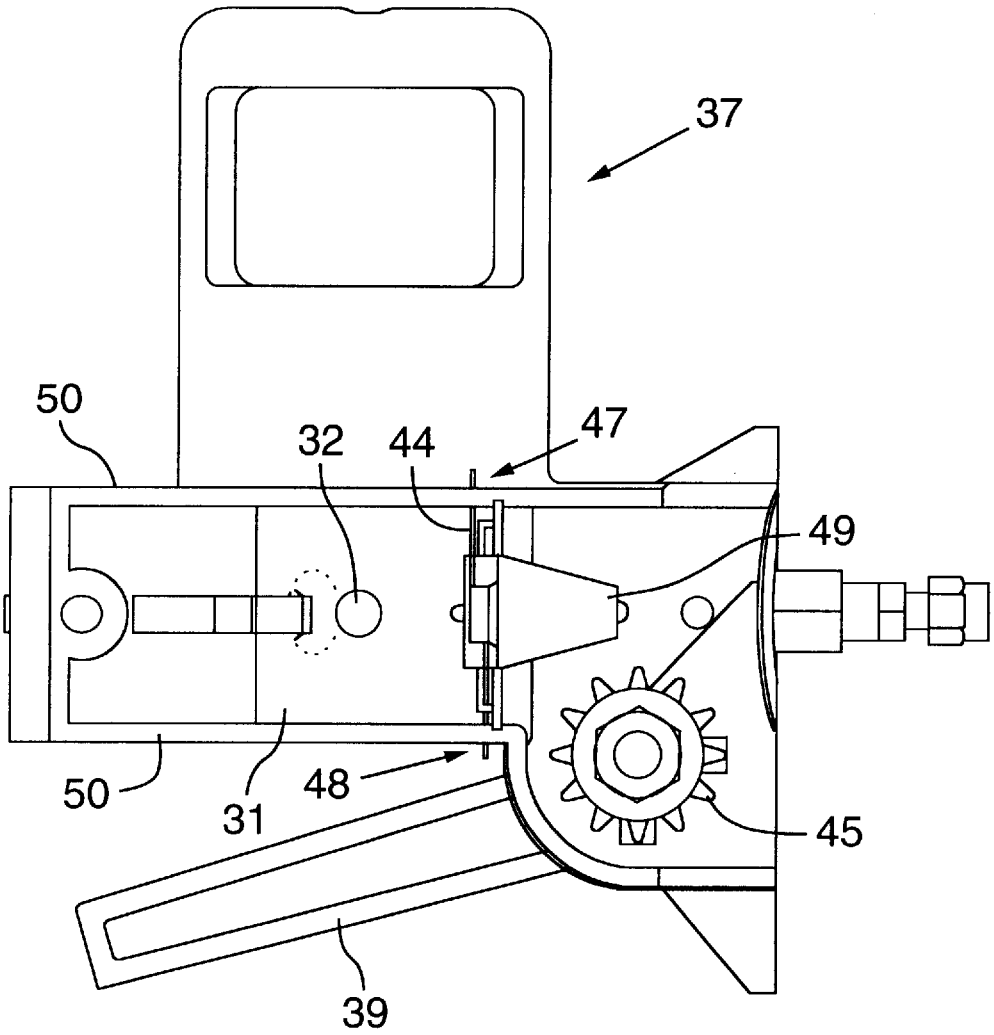
FIG. 11 is a schematic representation of the fill port adaptor, through C—C of FIG. 10.

FIG. 11 shows a bottom view of fill port adaptor 35 of FIG. 10. Fill port adaptor cover 30, especially plate section 31 thereof, is in cover guides 50, and is adapted to slide in such guides. Spring 44, which could be replaced with an elastomeric member suitably attached to the fill port adaptor, is shown as passing through orifices 47 and 48, which are located in guide 50. Cover stop support 49 is the support for cover stop 33, not shown.

Figure 12:
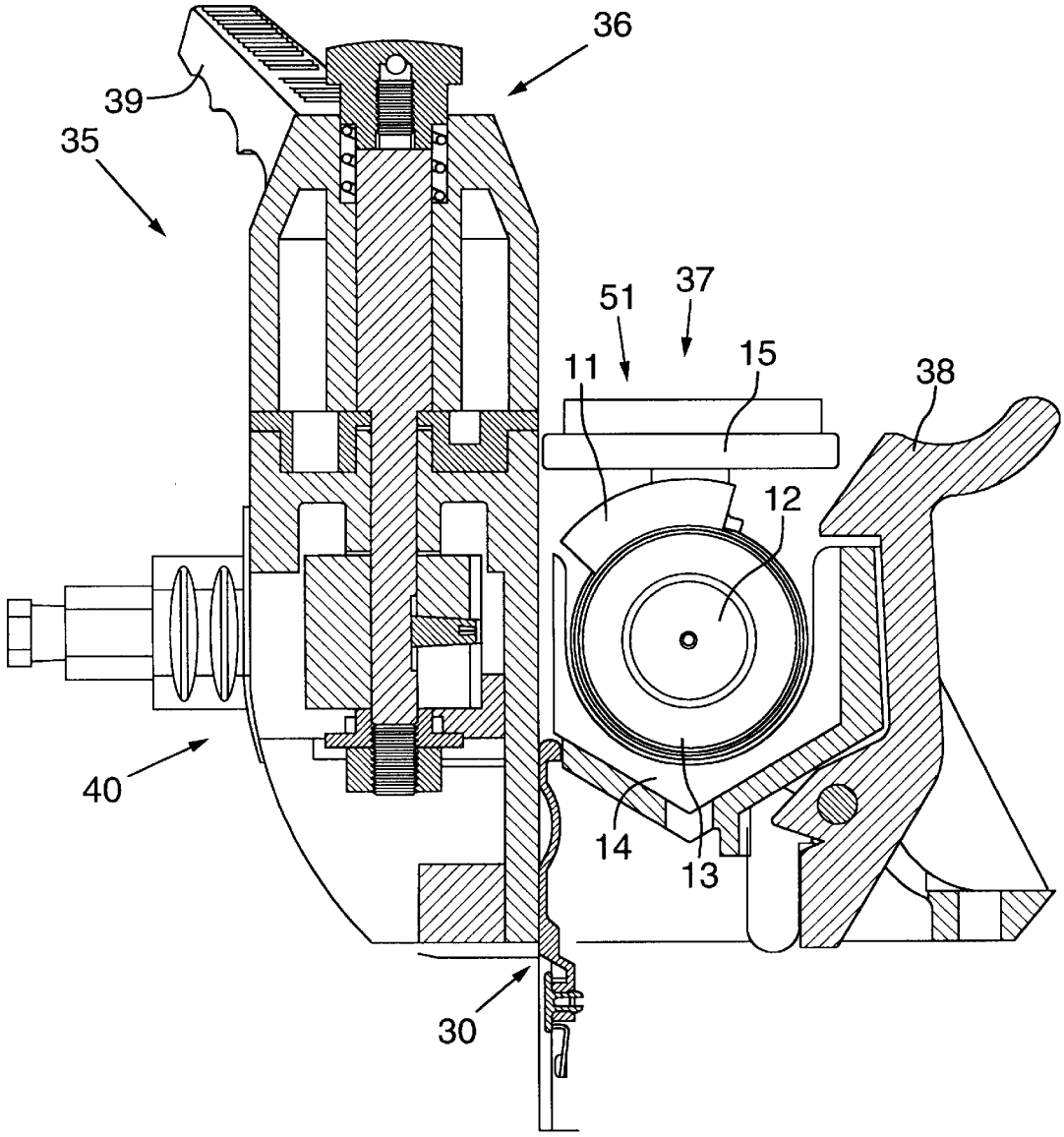
FIG. 12 is a schematic representation of a fill port adaptor connected to the flow controller, with the covers of the invention.

FIG. 12 shows a flow controller, generally indicated by 51, located in cradle 37. Flow controller 51 is held in place by locking clip 38. Cover 11 is shown in its open position, having rotated around housing 13. In addition, fill port adaptor cover 30 is in a downward position. Handle 39 has been rotated, and has extended gear rack 40 inwards into control mechanism 36, which in turn has inserted a fill port (not shown) into flow controller 51.

In operation of a cover on a flow controller, cover 1 is placed on a flow controller in the manner shown in FIG. 4. Elongated flexible members 3 are curled around housing 13, in elongated member grooves 23 such that locking projection 4 is inserted and snapped into position into locking recess 5. Elastic cord 19 is placed juxtaposed to and held in position by cover lip 6 (18) and extends around elastic cord groove 22 and held in position on the opposed end by cradle housing lip 20. In this manner, cover 11 is located on flow controller 10 and is able to rotate upwards, as illustrated in FIG. 4, to expose a fill port, 29, of flow controller 10, the fill port being located under cover plate 17 shown in FIG. 4.

Elastic cord 19 ensures that when pressure is not exerted to rotate cover plate 17 around housing 13, cover plate 17 will be urged into the position shown in FIG. 4. Rotation of cover plate 17 into the position exposing fill port of the flow controller is shown in FIG. 7. Such rotation of cover plate 17 would occur on insertion of a flow controller into a fill port adaptor, of the type shown in FIG. 9 and illustrated in the aforementioned U.S. application Ser. No. 08/797,823.

Fill port adaptor cover 30 covers the port for the high pressure outlet of fill port adaptor 35. Fill port adaptor cover 30 is urged into position by springs 44 so that in a non-operational position, fill port adaptor cover 30 covers the high pressure port. When a flow controller is inserted into cradle 37, fill port adaptor cover 30 is forced downwards, in the embodiment shown in FIG. 9, to expose the high pressure port. It is then possible for the high pressure port to be inserted into the inlet of flow controller 10 located in cradle 37.

Fill port adaptor cover 30 has cover stop 33 extending therefrom, which contacts shaft face 42 of the high pressure port. Cover stop 33 thereby prevents handle 39 being rotated to insert high pressure port into cradle 37 when a flow controller 10 is not properly located within cradle 37. For instance, cover stop 33 prevents the insertion of a high pressure port into flow controller 10 if flow controller 10 is improperly inserted into cradle 37. In addition, regulator cover 30 is disposed to revert to its closed position, as shown in FIG. 9, being urged into that position by cover spring 44. Thus, on removal of a flow controller from cradle 37, regulator cover 30 automatically moves into a position to protect high pressure port.

The covers of the present invention, which may be used independently, but which preferably are used concurrently, provide protection for a high pressure port and for the inlet on a flow controller. Concurrent use protects both the high pressure regulator and the flow controller from contamination by dirt or other materials, and further prevents damage to the port and to the flow controller by insertion of objects into the respective ports. In addition, the regulator covers are disposed to require that the flow controller is properly inserted into the cradle of the high pressure regulator, failing which one or both of the regulator covers will be located over the respective ports and prevent insertion of the high pressure port into the flow controller.

We claim:

1. A cover for a fill port in a housing of a pressurized vessel, comprising a pressurized vessel having a housing, a cover plate capable of sliding from a first position to a second position and at least one flexible elongated curved member located in a circular groove in said housing, said elongated curved member having opposed ends each of which may be attached to the cover plate.

2. The cover of claim 1 in which one end of the flexible elongated curved member is integrally connected to the cover plate.

3. The cover of claim 2 in which said cover has two elongated members.

4. The cover of claim 3 in which one end of each of said elongated members is integrally connected to the cover plate.

5. A flow controller for a pressurized vessel, said flow controller having a fill port for pressurizing of said vessel, said fill port being recessed in a housing, said fill port having a cover comprising a cover plate capable of sliding from a first position to a second position, said first position covering said fill port, said cover being biased towards said first position, said housing having at least one circular groove and said cover plate having an flexible elongated curved member located in said circular groove, said flexible elongated curved member having opposed ends each of which may be attached to the cover plate.

6. The flow controller of claim 5 in which the housing has two elongated grooves and the cover plate has elongated members located in each of said grooves.

7. The flow controller of claim 6 in which one end of each flexible elongated curved member of the cover is integrally connected to the cover plate.

8. The flow controller of claim 7 in which the cover plate is external to said housing.

9. The flow controller of claim 7 in which the housing has two radial grooves on opposed sides of said fill port, said cover plate having elastic means to bias said cover plate towards said first position.

10. A high pressure fitting for filling a cylinder with a pressurized gas, said fitting having a fill port adaptor with a movable injection port, said fill port adaptor being open for flow of gas into a flow controller of said cylinder when said injection port is received in a fill port in said flow controller and closed for flow of gas when not so received, said movable injection port having a cover thereon that is movable from a first position to a second position, said first position covering said movable injection port and preventing movement of said movable injection port, and said second position permitting said movable injection port to enter said fill port in the flow controller.

11. The high pressure fitting of claim 10 in which said cover is biased towards the first position.

12. The high pressure fitting of claim 11 in which said cover is biased to the first position by a spring or elastic means.

13. Apparatus for filling a cylinder with a pressurized gas, said apparatus comprising a high pressure fitting having a fill port adaptor and a flow controller system located on said cylinder;

said fill port adaptor having a movable injection port, a cradle and a locking clamp;

said flow controller system having a fill port located in a housing and cooperatively adapted to receive said movable injection port, said flow controller and said fill port adaptor being open for flow of gas when said movable injection port is received in said fill port and closed for flow of gas when not so received;

said locking clamp being adapted to lock the flow controller system of the cylinder in said cradle of the high pressure fitting;

said movable injection port having a cover thereon that is moved from a first position to a second position when the flow controller is placed in the cradle, said first position covering said movable injection port and preventing movement of said movable injection port, and said second position permitting said movable injection port to enter said fill port.

14. The apparatus of claim 13 in which said fill port of the flow controller system has a cover comprising a cover plate capable of sliding from a first position to a second position, said first position covering said fill port, said cover being biased towards said first position, said housing having at least one circular groove and said cover plate having an flexible elongated curved member located in said circular groove, said elongated curved member having opposed ends each of which is attached to the cover plate, said cover plate being moved from the first position to the second position when the controller is placed in the cradle, said second position permitting said fill port to receive said movable injection port.

15. The apparatus of claim 14 in which one end of the flexible elongated curved member is integrally connected to the cover plate.

16. The apparatus of claim 15 in which the housing has two elongated grooves and the cover plate has elongated members located in each of said grooves.

17. The apparatus of claim 16 in which one end of each flexible elongated curved member of the cover is integrally connected to the cover plate.

18. The apparatus of claim 17 in which the cover plate is external to said housing.

19. The apparatus of claim 18 in which the flow controller has two radial grooves on opposed sides of said inlet, said cover plate having elastic means to bias said cover plate towards said first position.

20. The apparatus of claim 19 in which the cover of the high pressure fitting is biased towards the first position.

* * * * *